US005271534A

United States Patent [19]

Fillmore et al.

[11] Patent Number: 5,271,534

[45] Date of Patent: Dec. 21, 1993

[54] DISPENSER PACKAGE FOR VISCOUS PRODUCTS

[75] Inventors: William E. Fillmore, Toledo; Raj Krishna, Sylvania, both of Ohio

[73] Assignee: Owens-Illinois Closure Inc., Toledo, Ohio

[21] Appl. No.: 832,820

[22] Filed: Feb. 7, 1992

Related U.S. Application Data

[63] Continuation-in-part of Ser. No. 759,328, Sep. 13, 1991.

[51] Int. Cl.[5] ..... B67D 5/42

[52] U.S. Cl. ..... 222/383; 222/386.5

[58] Field of Search ..... 222/94, 95, 386.5, 380, 222/383, 385, 257-260, 105

[56] References Cited

U.S. PATENT DOCUMENTS

| | | | |
|---|---|---|---|
| 2,608,320 | 8/1952 | Harrison | 222/95 |
| 3,241,722 | 3/1966 | Nissen | 222/136 |
| 3,420,413 | 1/1969 | Corsette . | |
| 3,880,326 | 4/1975 | Kennard et al. | 222/95 |
| 4,671,428 | 6/1987 | Spatz | 222/207 X |
| 4,838,460 | 6/1989 | Moore et al. | 222/260 X |
| 4,848,595 | 7/1989 | Foster et al. | 222/559 X |
| 4,875,604 | 10/1989 | Czech | 222/257 |
| 4,903,868 | 2/1990 | Ichihara et al. | 222/383 X |
| 5,004,123 | 4/1991 | Stoody | 222/94 |

FOREIGN PATENT DOCUMENTS

| | | | |
|---|---|---|---|
| 0084638 | 8/1983 | European Pat. Off. | 222/384 |

*Primary Examiner*—Andres Kashnikow
*Assistant Examiner*—Kenneth DeRosa

[57] ABSTRACT

A dispenser package for viscous products comprising a container, a hanger and pouch assembly of plastic material suspended in the container and a head including a pumping mechanism mounted on the container. The head includes a chamber with a first one way valve adjacent an opening in the hanger and pouch assembly and a second one way valve adjacent an outlet of the pumping mechanism.

7 Claims, 6 Drawing Sheets

DISPENSER PACKAGE FOR VISCOUS PRODUCTS

This is a continuation-in-part of application Ser. No. 07/759,328 filed Sep. 13, 1991.

This invention relates to dispensing packages for viscouss products.

BACKGROUND AND SUMMARY OF THE INVENTION

In copending Patent Application Ser. No. 07/759,328 filed Sep. 13, 1991 there is disclosed and claimed a squeeze dispenser package comprising a container having a compressible portion and a hanger and pouch assembly of plastic material suspended in the container. The hanger has an upper portion having an opening and a flexible film pouch having an opening is bonded to the opening in the hanger. The hanger has a lower flexible portion comprising spaced flexible walls. In one form, a removable head is mounted on the container and overlies the hanger and pouch assembly. The head includes a nozzle having an opening overlying the opening in the pouch and an atmospheric valve is provided for equalizing the pressure after the compressible portion of the container has been released and the hanger and pouch assembly returns to its original position.

Another type of dispenser package for viscous products comprises a rigid container with a manual pumping mechanism such as shown, for example, in copending application Ser. No. 07/715,817 filed Jun. 14, 1991. Flexible pouches have been suggested for use in such dispensers as shown in United States Pat. No. 3,420,413.

Among the objectives of the present invention are to provide a dispensing package for viscous products which has a relatively rigid container and utilizes a hanger and pouch assembly which can be replaced and a head including a hand operated pumping mechanism which can be reused.

In accordance with the invention, a dispenser package for viscous products comprises an container, a hanger and pouch assembly of plastic material suspended in the container and a head including a pumping mechanism mounted on the container. The head includes a chamber with a first one way valve adjacent an opening in the hanger and pouch assembly and a second one way valve adjacent an outlet of the pumping mechanism.

DESCRIPTION

Referring to FIGS. 1-5, the dispensing package embodying the invention comprises a container 10, a hanger and pouch assembly 11 and a removable head assembly 12 as well as a snap on cap 13.

Figure 3:
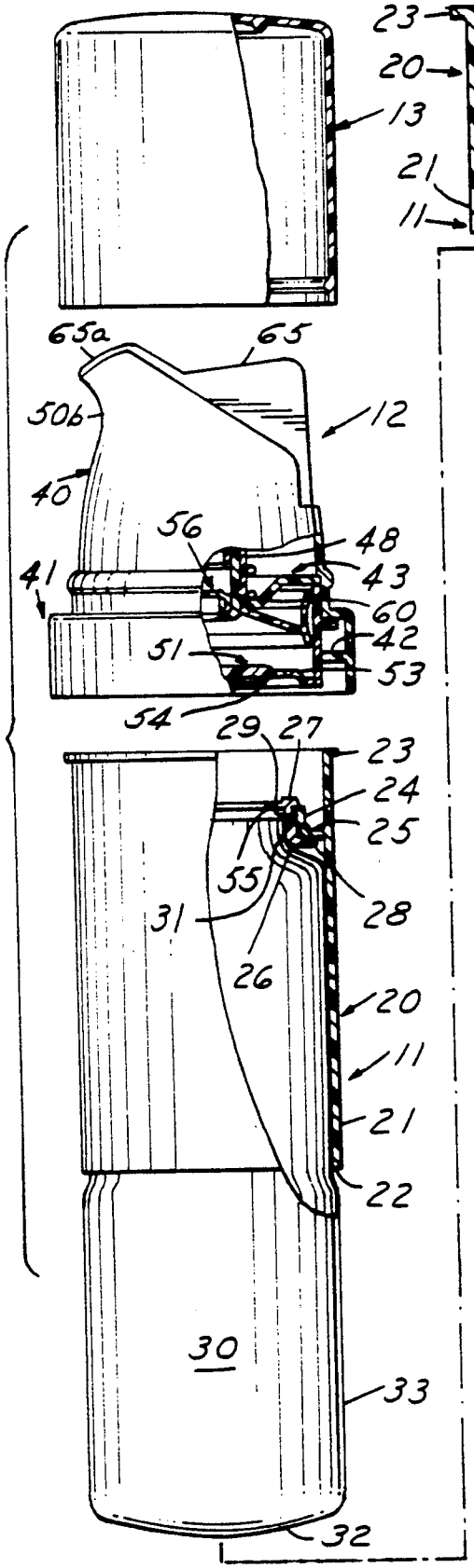
FIG. 3 is an exploded view of the package shown in FIGS. 1 and 2.

The container 10 is made of plastic material and includes a side wall 14, an integral bottom wall 15 having an opening 16 and a peripheral annular base 17 forming a foot so that the container can be placed upright on a flat surface. The container 10 further includes a thread 18 on the upper end and an annular flange 19 below the thread 18 (FIG. 3).

The hanger and pouch assembly 11 includes a plastic hanger 20 having a cylindrical body portion 21 an open bottom end 22 and an integral annular flange 23 extending radially about the open upper end. The hanger 20 further includes an integral annular wall 24 spaced below the flange 23 and integrally connected by radial wall 25 with the interior surface of the hanger 20 and defining an opening.

Figure 3A:
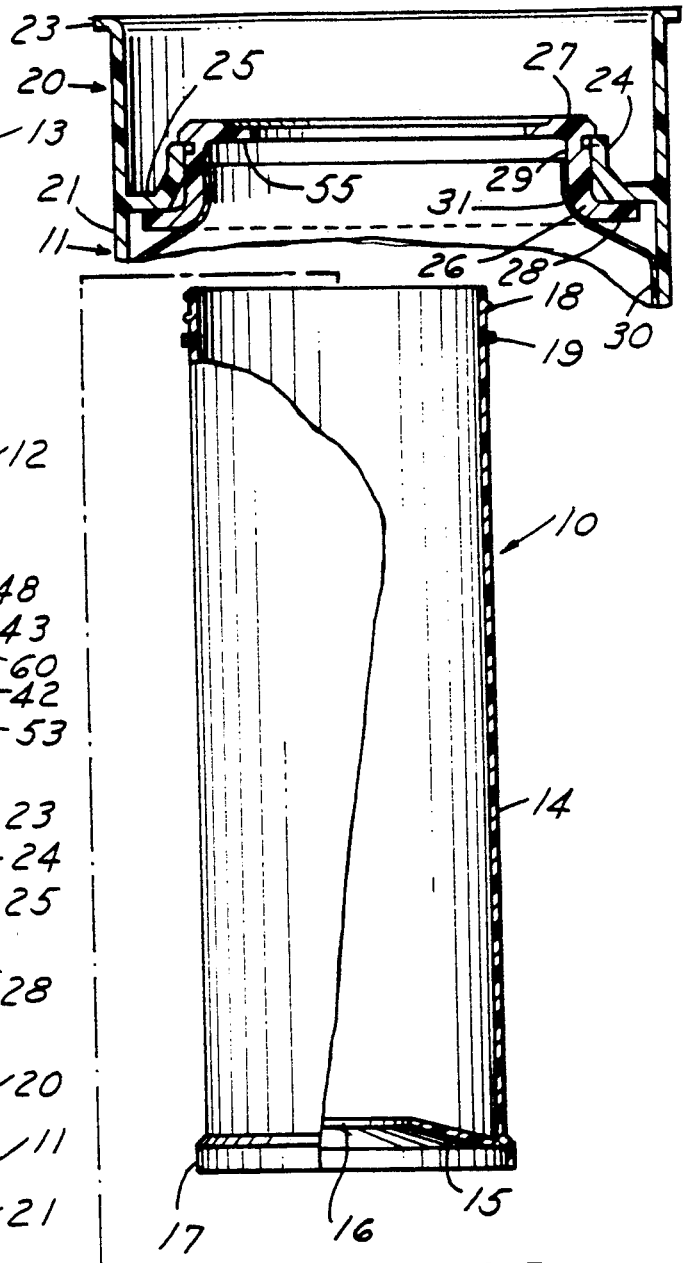
FIG. 3A is a fragmentary sectional view of a portion of the package.

A plastic ferrule 26 is snapped onto the wall 24, the ferrule having spaced flanges 27 and 28 for retaining the ferrule on the wall 24 (FIG. 3A). The ferrule 26 defines an opening 29 for dispensing the viscous product which is supported in a flexible plastic pouch 30 that has an open end 31, a closed bottom end 32, and a cylindrical side wall 33 having and an open end 31 that is bonded to the inner surface of the wall 29 of the ferrule 26 as by heat sealing. The pouch 30 is also bonded at spaced areas to the inside surface of the body portion 21 of hanger 20, preferably adjacent the lower end of the body portion 21.

The head 12 includes a housing 40 having a lower peripheral skirt 41 with internal threads 42 which engage the threads 18 on the upper end of the container 10. The housing 40 supports the pumping mechanism 43, which may be of any well known construction. The pumping mechanism is preferably of the type shown in the aforementioned patent application Ser. No. 07/715,187 incorporated herein by reference. The pumping mechanism 43 includes a transversely extending inner member 44 which is frictionally interlocked with housing 40 by a cylinder 45 which snaps into engagement with spaced internal ribs 46 on the housing 40.

A separate reciprocable, pumping or dosing piston 47. The dosing piston 47 has an integral upwardly extending portion 48. The upwardly extending portion 48 of the dosing piston 47 extends through an opening in the end member 44 and is within such opening. The upwardly extending portion 48 of the dosing piston 47 includes a collar 49 which is coaxially fitted thereto and which is in telescopic slidable communication with the inlet portion **50*a* of the dispensing spout 50 of the housing 40 to permit product to be dispensed from the container throughout the range of travel of the dosing piston 47. An outlet portion 50*b* of the dispensing spout 50 extends obliquely from the inlet portion 50*a*, which is coaxial with the longitudinal central axis of the container and the upwardly extending portion 48 of the dosing piston 47**. The orientation of the inlet portion is best suited for the flow of product from within the body and the orientation of the outlet portion provides that the product will be dispensed at a location which is quite convenient for a user who is grasping the package for application to an article such as a toothbrush.

Figure 5:
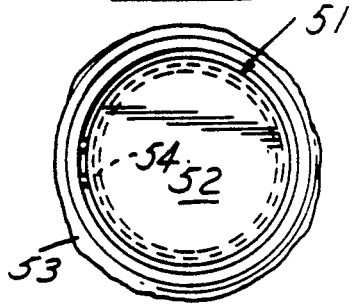
FIG. 5 is a plan view of another valve utilized in the package shown in FIGS. 1-3.

An integral one way valve 51 is provided adjacent the lower portion of the dispensing chamber D adjacent the opening in the ferrule 26 which cooperates with a radial wall 55 of the ferrule 26 to provide a seal. Valve 51 is shown in FIG. 5 and comprises a flat annular disk 52 connected to the inwardly extending annular flange 53 on the skirt of the cylinder wall 45 and having an annular bead 54 on the under surface thereof engaging a radial wall 55 on the ferrule 26 to provide the seat.

Figure 4A:
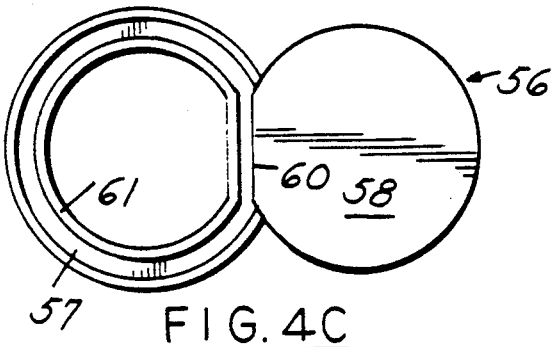
FIGS. 4A, 4B and 4C are views of a valve utilized in the package shown in FIGS. 1-3.
Figure 4B:
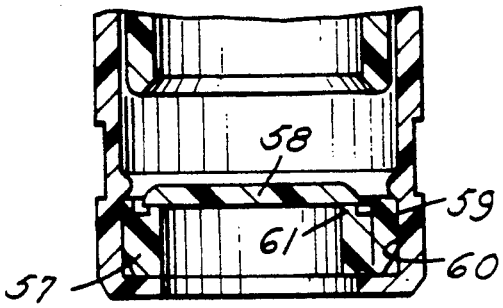
Figure 4C:
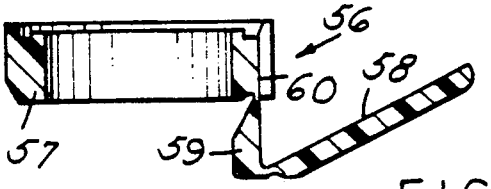

In accordance with the invention, a second one way valve 56 is provided on the collar and is preferably of the construction shown FIGS. 4A, 4B and 4C wherein the valve is molded by injection molding in the configuration shown in FIG. 4C and includes an annular wall 57, a sealing flap 58 connected by an integral hinge 59 to the annular wall. After molding, the hinge is bent to bring the hinge 59 into an axial groove 60 and the disk 58 into the position shown in FIG. **4*b* where the memory of the plastic holds the disk 58 yieldingly against an integral annular axially extending seat 61**.

In order to assemble the package, the hanger and pouch assembly 11 are first inserted in the container 10 and the flange 23 on the hanger 20 engages the upper end of the container 10. The pouch is then filled with product through the ferrule 26. The head assembly 12 is then threaded onto the container and thereby holds the hanger and pouch assembly in position.

A dose or shot of product from the container 10 is dispensed by moving the dosing piston 47 downwardly. This pressurizes the product in chamber D in a way which can only be relieved by the flow or displacement of product outwardly from the chamber D, given the one-way limitation on the travel of the valve 51. The downward movement of the dosing piston 47 is actuated by a pumping lever 65 which is carried by the housing 40 and which is oscillatable with respect to the head portion 16 about opposed coaxial axes (not shown) on housing 40. The pumping lever 65 is preferably of a different color than the housing 40 to be readily distinguishable therefrom.

Figure 2:
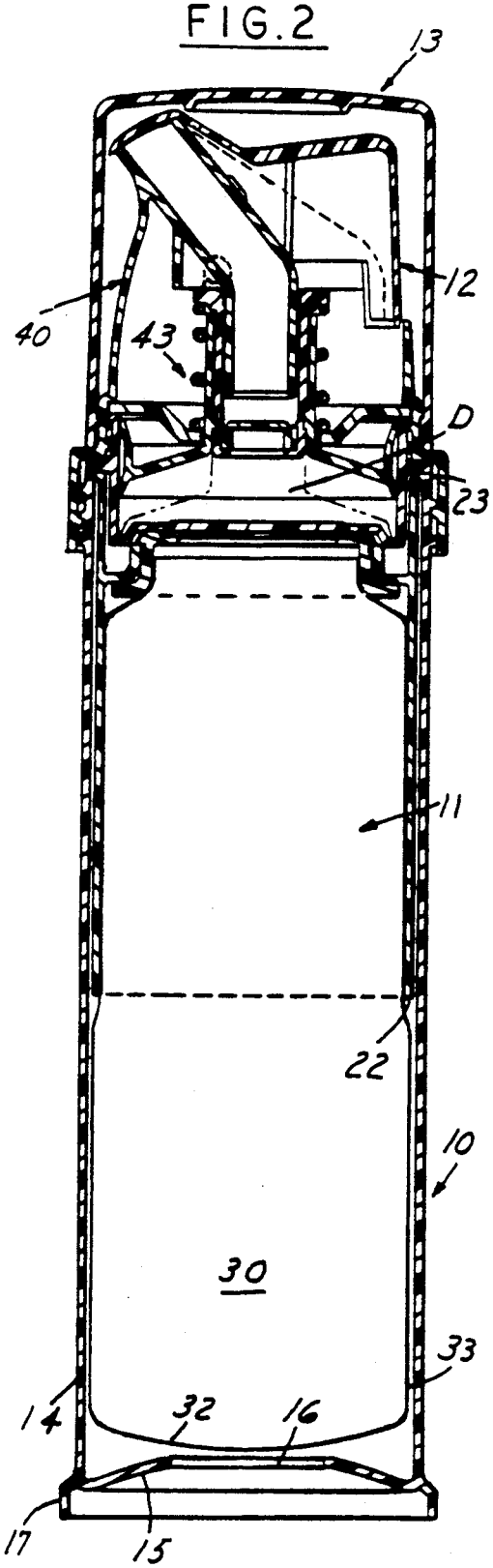
FIG. 2 is a vertical sectional view of the package shown in FIG. 1.
Figure 1:
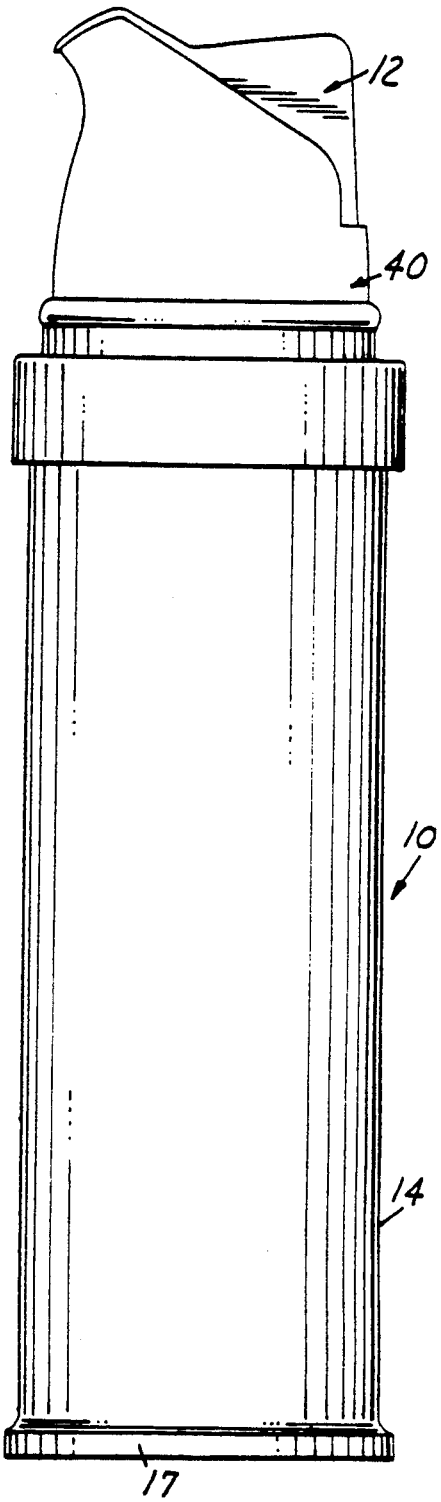
FIG. 1 is a elevation view of a dispensing package embodying the invention.

To initiate a dispensing cycle, a finger engaging portion of the pumping lever 65 is moved by finger force through a limited arc in a clockwise direction in the orientation of the package 14 as viewed in FIG. 2. This action lifts a tip portion **65*a* of the pumping lever 65 clear of the outlet portion 50*b*. The clockwise movement of the pumping lever 65, as described, also moves the piston 47 downwardly. After the desired amount of product has been dispensed from the container, the finger force is removed from the pumping lever 65. A spring 60 will then return the pumping lever 65 to its original position, substantially closing the tip of the dispensing spout 50*b*, to await the next dispensing cycle. This will also cause the second one-way valve 56 to close and the valve 51** to open so that viscous product can be drawn by the reduced pressure into chamber D to replenish the product dispensed.

Figure 9:
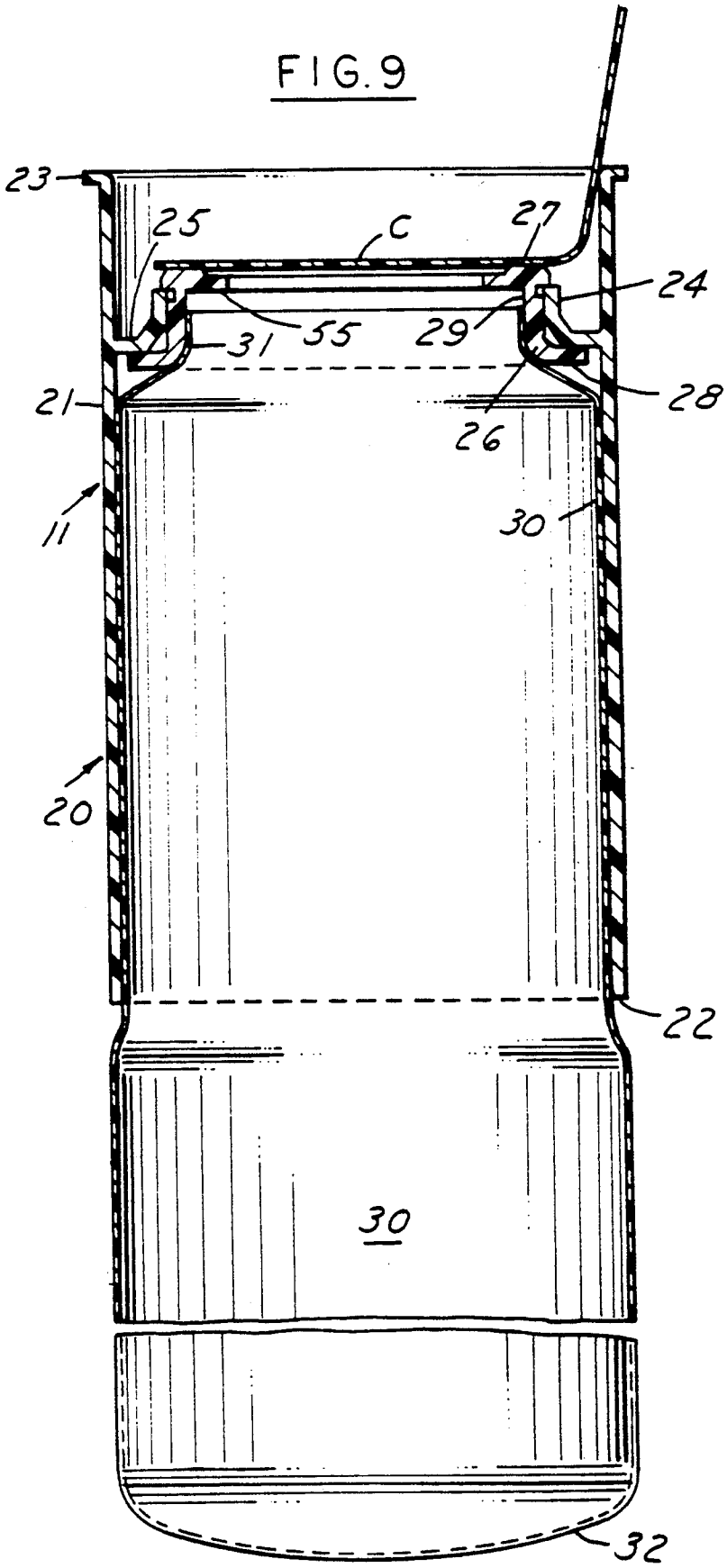
FIG. 9 is a vertical sectional view of a refill cartridge.

After all or substantially all product has been dispensed from the body portion 18 in a multiplicity of doses or shots, each of a relatively small mass, the container 10 and head 12 may be disengaged from one another. The exhausted hanger and pouch assembly 11 can be removed and a fresh hanger and pouch assembly 11 be inserted. The head portion 10 can then be reapplied. The replacement hanger and pouch assembly 11 includes a removable closing member C (FIG. 9).

Figure 6:
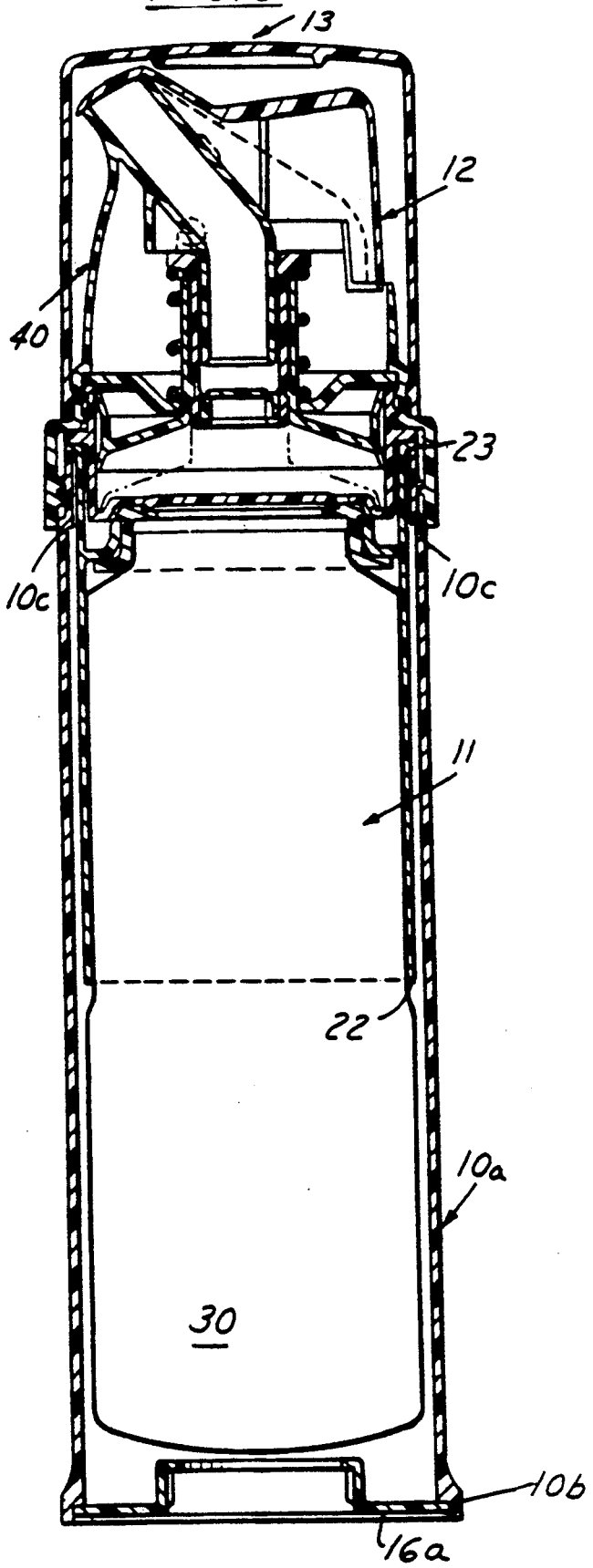
FIG. 6 is a vertical sectional view of a modified form of dispensing package.

In the modified form of dispenser package shown in FIG. 6, the construction is identical to that in the form shown in FIGS. 1-5 except that the container **10*a* has a separate bottom member 16*a* and is formed with a thickened portion 10*b* on the outer wall 15*a* to provide a foot for engaging a flat surface. The container 10*a* further differs in that the upper end thereof has a shoulder 10*c*** adjacent the threaded portion. In all other respects the inner is the same.

Figure 7:
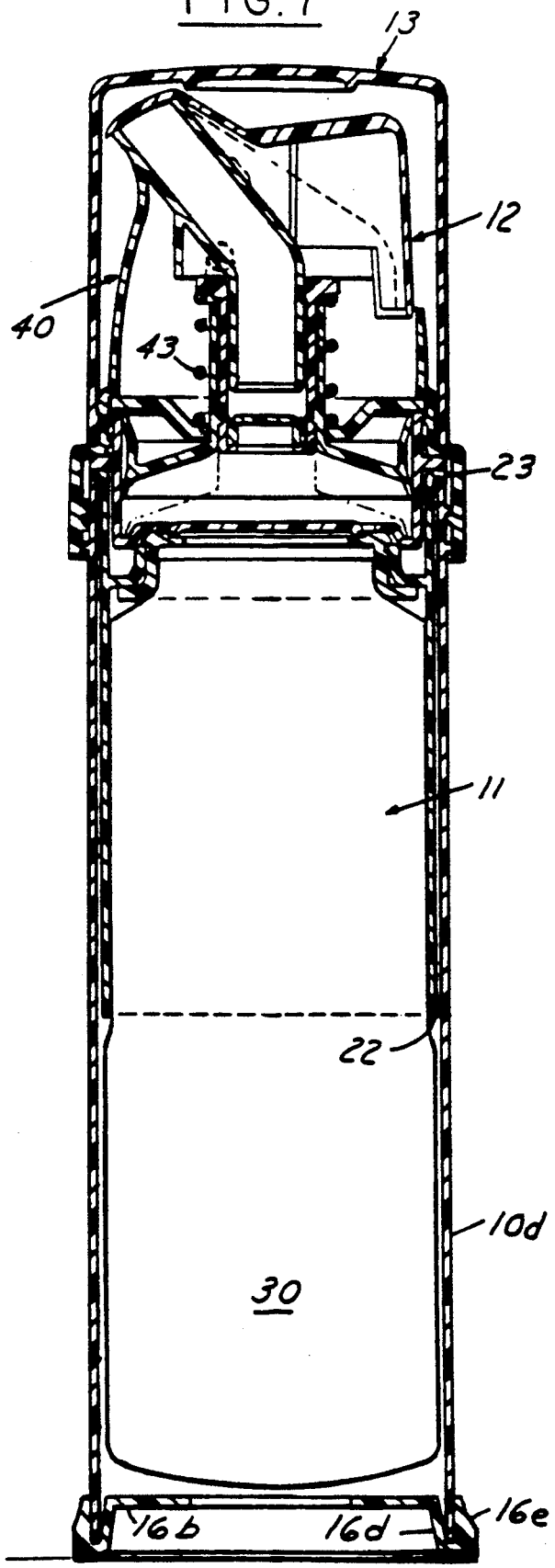
FIG. 7 is a sectional view other modified form of dispensing package.

In the form shown in FIG. 7, the construction is substantially identical to that shown in FIGS. 1-5 except that the bottom wall **16*b* of the container is made as a separate part and includes spaced axial walls 16*d*, 16*e* defining a groove into which the lower end of the container 10*d*** extends.

Figure 8:
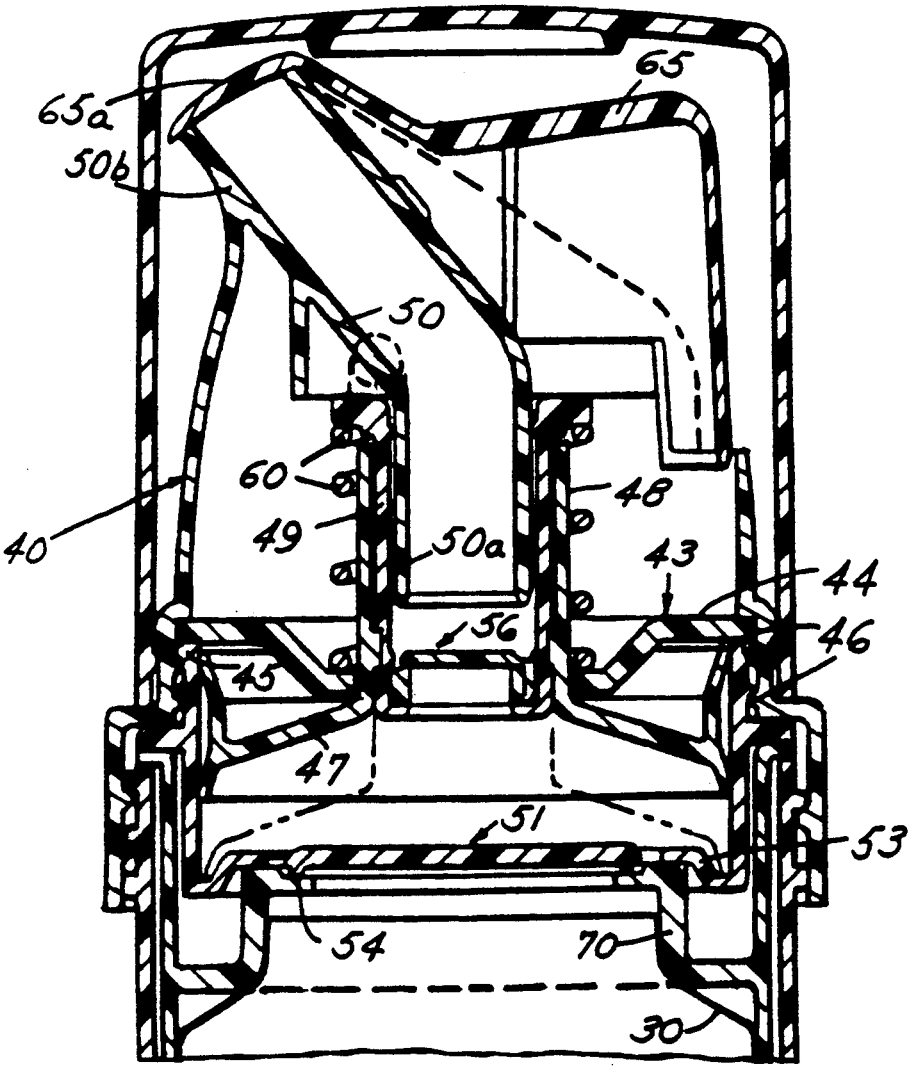
FIG. 8 is an enlarged sectional view of a portion of another form of package.

In the form shown in FIG. 8, the ferrule is omitted and the pouch is sealed directly to an integral vertical wall 70 on the hanger.

We claim:

1. A dispensing package comprising a plastic container including a bottom wall, substantially rigid side walls and an open end, a hanger and pouch assembly, said hanger and pouch assembly comprising a hanger made of plastic material, said hanger having an annular body and an opening, said hanger having an upper portion and a lower portion, means for suspending said hanger in said container, a plastic film pouch extending within said hanger having an opening bonded adjacent the opening in the hanger and having portions thereof bonded to said hanger, said pouch having an upper portion and a lower portion, said lower portion comprising a sealed flexible lower portion extending beyond the lower portion of said hanger, means overlying said hanger for closing the opening end of the container and including a dispensing nozzle, means on said means overlying said hanger operable upon manual manipulation for dispensing the contents in said pouch through said dispensing nozzle, said means overlying said hanger for closing the open end of the container comprising a head, and means removably mounting said head on said container, said head including a pumping chamber, a first one way valve associated with said pumping chamber adjacent the opening in the hanger, and a second one-way valve associated with said pumping chamber adjacent said dispensing nozzle, said first one-way valve being integral with said pumping chamber, a ferrule inserted into said opening in said hanger, said ferrule having an opening therethrough said pouch being bonded to said ferrule, said first one-way valve including a valve element engaging said ferrule.

2. The dispensing package set forth in claim 1 wherein said pouch is bonded to said opening in the ferrule.

3. The dispensing package comprising a plastic container including a bottom wall, substantially rigid side walls and an open end, a hanger and pouch assembly, said hanger and pouch assembly comprising a hanger made of plastic material, said hanger having an annular body and an opening, said hanger having an upper portion and a lower portion, means for suspending said hanger in said container, a plastic film pouch extending within said hanger having an opening bonded adjacent the opening in the hanger and having portions thereof bonded to said hanger, said pouch having an upper portion and a lower portion, said lower portion comprising a sealed flexible lower portion extending beyond the lower portion of said hanger, means overlying said hanger for closing the open end of the container and including a dispensing nozzle, means on said means overlying said hanger operable upon manual manipulation for dispensing the contents in said pouch through said dispensing nozzle, said means overlying said hanger for closing the open end of the container comprising a head, and means removably mounting said head on said container, said head including a pumping chamber, a first one way valve associated with said pumping chamber adjacent the opening in the hanger, and a second one-way valve associated with said pumping chamber adjacent said dispensing nozzle, said second one-way valve comprising a one piece plastic body including an annular wall, a sealing disk connected by an integral hinge to one end of said annular wall, said annular wall having an axial groove on an external surface thereof, said hinge extending through said groove such that said sealing disk engages a seal on the other end of said annular wall.

4. The dispensing package set forth in claim 3 wherein said means operable upon manual manipulation comprises a reciprocable piston positioned adjacent a first end of said pumping chamber, said piston having a flow passage extending therethrough, said piston being movable in a first direction toward a second end of said pumping chamber, movement of said piston in said first direction pressurizing the mass of viscous product and causing a dose of viscous product from the mass to be dispensed from the package through said flow passage;

said head having manually oscillatable pumping mechanism, said pumping mechanism operatively engaging said reciprocating piston and being movable in an arc in a first arcuate direction to move said piston in said first direction from a first position to a second position upon the application of force to said pumping mechanism;

said head further having biasing means, said biasing means urging said pumping mechanism in an arc in a second arcuate direction, said second arcuate direction being opposed to said first arcuate direction, said biasing means moving said piston from said second position to said first position upon the release of the external force from said pumping mechanism.

5. A dispensing package comprising a plastic container including a bottom wall, substantially rigid side walls and an open end, a hanger and pouch assembly, said hanger and pouch assembly comprising a hanger made of plastic material, said hanger having an annular body and an opening, said hanger having an upper portion and a lower portion, means for suspending said hanger in said container, a plastic film pouch extending within said hanger having an opening bonded adjacent the opening in the hanger and having portions thereof bonded to said hanger, said pouch having an upper portion and a lower portion, said lower portion comprising a sealed flexible lower portion extending beyond the lower portion of said hanger, means overlying said hanger for closing the open end of the container and including a dispensing nozzle, and means on said means overlying said hanger operable upon manual manipulation for dispensing the contents in said pouch through said dispensing nozzle, said means overlying said hanger for closing the open end of the container comprising a head, and means removably mounting said head on said container, said head including a pumping chamber, a first one-way valve associated with said pumping chamber adjacent the opening in the hanger, and a second one-way valve associated with said pumping chamber adjacent said dispensing nozzle, said first one-way valve being integral with said pumping chamber, said pouch being bonded directly to said hanger, said first one-way valve having a valve element engaging said hanger.

6. The dispensing package set forth in claim 5 wherein said means operable upon manual manipulation comprises a reciprocable piston positioned adjacent a first end of said pumping chamber, said piston having a flow passage extending therethrough, said piston being movable in a first direction toward a second end of said pumping chamber, movement of said piston in said first direction pressurizing the mass of viscous product and causing a dose of viscous product from the mass to be dispensed from the package through said flow passage;

said head having manually oscillatable pumping mechanism, said pumping mechanism operatively engaging said reciprocating piston and being movable in an arc in a first arcuate direction to move said piston in said first direction from said position to a second position upon the application of force to said pumping mechanism;

said head further having biasing means, said biasing means urging said pumping mechanism in an arc in a second arcuate direction, said second arcuate direction having opposed to said first arcuate direction, said biasing means moving said piston from said second position to said first position upon the release of the external force from said pumping mechanism.

7. A dispensing package comprising a plastic container including a bottom wall, substantially rigid side walls and an open end, a hanger and pouch assembly, said hanger and pouch assembly comprising a hanger made of plastic material, said hanger having an annular body and an opening, said hanger having an upper portion and a lower portion, means for suspending said hanger in said container, a plastic film pouch extending within said hanger having an opening bonded adjacent the opening in the hanger and having portions thereof bonded to said hanger, said pouch having an upper portion and a lower portion, said lower portion comprising a sealed flexible lower portion extending beyond the lower portion of said hanger, means overlying said hanger for closing the open end of the container and including a dispensing nozzle, and means on said means overlying said hanger operable upon manual manipulation for dispensing the contents in said pouch through said dispensing nozzle, said means overlying said hanger for closing the open end of the container comprising a head, and means removably mounting said head on said container, said head including a pumping chamber, a first one way valve associated with said pumping chamber adjacent the opening in the hanger, and a second one-way valve associated with said pumping chamber adjacent said dispensing nozzle, said first one-way valve being integral with said pumping chamber, said pumping chamber including a piston operable by said means overlying said hanger and operable upon manual manipulation for dispensing the contents, a cylinder on said head, a transverse wall on said head, said transverse wall having an opening, said cylinder having an upwardly extending portion extending through said opening in said transverse wall, a collar coaxially fitted to said upwardly extending portion and a pumping lever engagable with said piston such that when said piston is moved by manual manipulation of said pumping lever said piston is moved toward said plastic film pouch assembly causing the contents in said pumping to be dispensed through said second one-way valve and such that when said manual manipulation is removed, said second one-way valve is closed and said first one-way valve opened such that viscous product is drawn by reduced pressure in said pumping chamber to replenish said produce in said pumping chamber.

* * * * *